United States Patent [19]

Alcott

[11] 4,411,299

[45] Oct. 25, 1983

[54] LOG SPLITTER

[75] Inventor: David K. Alcott, Rehoboth, Mass.

[73] Assignee: Haulamatic Corporation, East Providence, R.I.

[21] Appl. No.: 356,194

[22] Filed: Mar. 8, 1982

[51] Int. Cl.[3] ..... B27L 7/00

[52] U.S. Cl. ..... 144/193 R; 74/27; 74/37; 74/469; 254/266; 254/283; 254/346

[58] Field of Search ..... 254/283, 346, 266; 144/193 R, 3 K, 366; 74/37, 27, 469, 471 R

[56] References Cited

U.S. PATENT DOCUMENTS 4,133,359 1/1979 Jensen et al. ..... 144/193 R 4,222,419 9/1980 Oliver ..... 144/193 R

*Primary Examiner*—W. D. Bray

*Attorney, Agent, or Firm*—Salter & Michaelson

[57] ABSTRACT

An apparatus for splitting logs and the like is disclosed. The apparatus comprises an elongated track having an upstanding splitting wedge attached thereto and a ram slidingly mounted thereon. The ram includes an upstanding abutment plate and an upstanding drive plate which is spaced from the abutment plate on the opposite side thereof from the wedge. A cable-wound-drum electrical power unit which is operable with advance, hold and release modes is mounted at an intermediate point on the track between the drive and abutment plates with the cable of the power unit extending from the drum to the drive plate. Upon implementation of the advance mode of the power unit, the cable is wound onto the drum to pull the drive plate towards the power unit and thereby advance the abutment plate towards the wedge. The splitting of a log or the like interposed between the abutment plate and the wedge on the track is effected by advancing the abutment plate together with the log toward the wedge thereby causing the progressive longitudinal insertion of the wedge into the log. The ram is thereafter rapidly returned from the wedge by resilient spring members upon implementation of the release mode of the power unit.

13 Claims, 7 Drawing Figures

92
60
90
16
36
34
38
14
44
46
42
40
30
67
32
82
44
12
10
30
30

70
72
64
74
68
52
64
48
12
24
82
82

3
18
60
62
54
26
92
66
46
44
80
90
70
42
20
38
14
52
40
67
32
84
50
64
75
78
76
78
58
56
50
86
26
22
24
36
3
82
30
30

44
64
60
80
54
66
46
90
92
18
18
40
20
42
44
68
48
38
67
32
70
56
14
32
84
26
22
48
48
50
62
58
50
36
12
75
86
30

30
74
72
18
64
44
80
62
16
68
12
36
67
90
92
38
32
75
78
76
40
14
30
42
74
30

FIG. 6
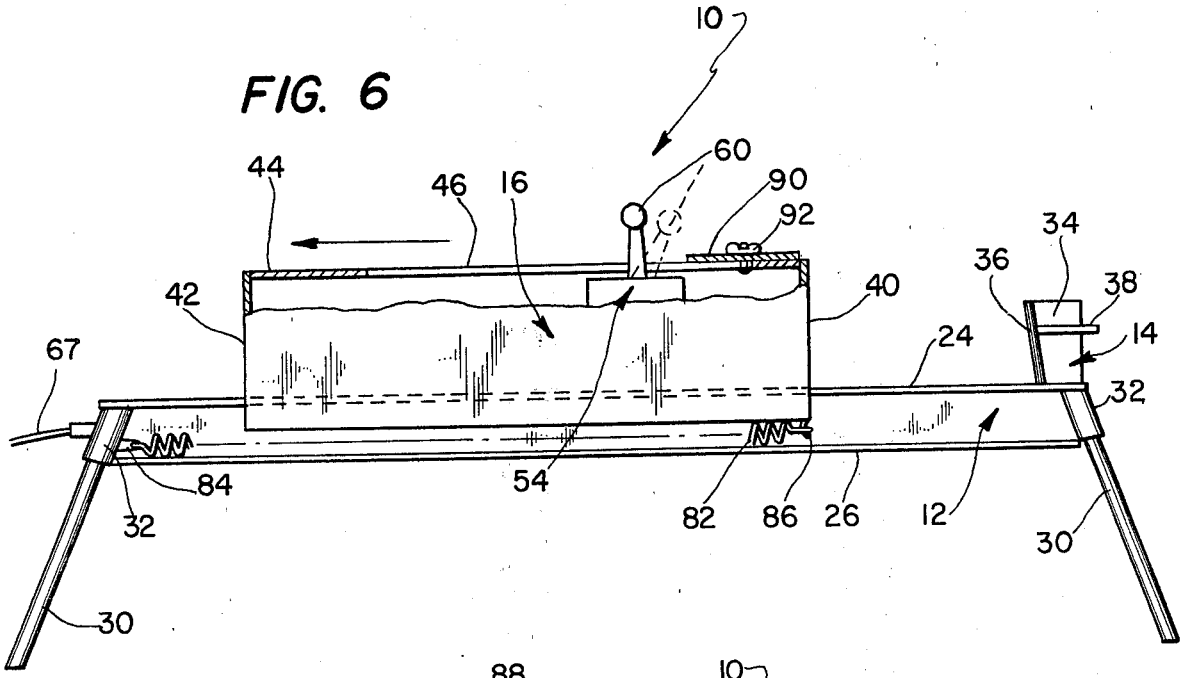
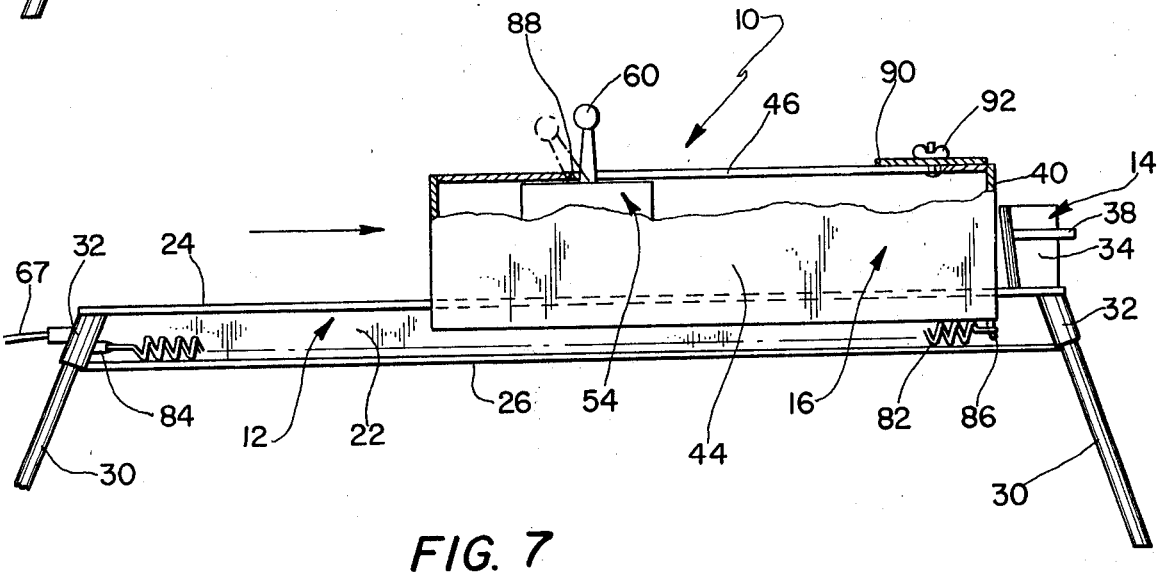
FIG. 7

LOG SPLITTER

BACKGROUND OF THE INVENTION

The instant invention relates to the splitting of wood and more particularly to a novel apparatus for splitting logs and the like.

Mechanical log splitting devices which operate by mechanically advancing a splitting wedge or blade into a log while the log is retained against a stationary abutment have been available since the early part of the twentieth century. In this connection, particular reference is made to the U.S. patent to INMAN, No. 1,310,660 issued in 1919 entitled WOOD SPLITTING MACHINE which discloses an example of an early log splitting device that incorporates a complex gear and cable assembly for mechanically advancing a splitting wedge into a stationary log. The U.S. patent to C. T. HANNERS, No. 2,446,585 issued in 1948 similarly discloses an apparatus of this general type wherein a splitting blade or wedge is mechanically advanced to effect the splitting of logs. Unfortunately, however, both of these early machines had the disadvantage that their drive mechanisms were overly complex and therefore somewhat unreliable. The complexity of the drive mechanisms of these machines also made the machine splitting cycle times somewhat excessive.

The recent shortages in world energy supplies have caused increasing numbers of people to turn to wood as an alternate form of energy for heating because of its relative abundance and low cost. This increased popularity in the use of wood as a heating fuel has stimulated recent technological advancements in the field of wood splitting machines. In this regard a number of relatively sophisticated hydraulically driven wood splitting machines have been developed and are currently available. While many of these hydraulic machines have proven effective and reliable for heavy duty wood splitting operations, they are generally very expensive and therefore frequently impractical for the average home owner. Comparatively long cycle times which are characteristic of many of these hydraulic machines also make them less than fully satisfactory.

Recent advancements have also been made in the technology relating to the mechanically driven wood splitting apparatus. In this regard reference is made to the U.S. patents to JENSEN et al, No. 4,133,359 and OLIVER, No. 4,22,419 which represent the closest prior art to the instant invention of which the applicant is aware. The apparatus disclosed in these patents differ from the earlier mechanically driven wood splitting machines in that they operate by mechanically advancing a log or a piece of wood towards a stationary wedge or splitting blade rather than by advancing a movable splitting blade into a stationary log. Nevertheless, both of the above machines still have the disadvantage of requiring comparatively complex drive mechanisms for their operation which tend to reduce both machine efficiency and durability.

SUMMARY OF THE INVENTION

The instant invention overcomes many of the disadvantages of the previously known wood splitting machines by providing a simple mechanically driven apparatus which is reliable and comparatively inexpensive and which has a relatively short cycle time. The apparatus incorporates a fixed track having an upstanding splitting wedge that is securely attached to one end thereof and a movable ram adapted for traveling movement on the track toward and away from the wedge. The splitting of a log interposed between the abutment and the wedge is effected by mechanically advancing the abutment toward the wedge so that the wedge is progressively inserted longitudinally into the log to gradually urge the sides of the log apart.

The apparatus of the instant invention is substantially simpler in its operation than the previously known machines which effect splitting in this general manner. Specifically, the ram of the apparatus is driven by a simple cable-wound-drum drive assembly which provides a simple but postitive means for advancing the ram at a safe and practical rate of speed. The ram is mechanically advanced on the track toward the wedge and includes an upstanding abutment and an upstanding drive plate which is connected to the abutment, but is spaced therefrom on the side thereof opposite to the wedge. A power unit which comprises part of the drive assembly and includes the above mentioned cable-wound-drum is securely mounted on the track at an intermediate point in its extent between the abutment and the drive plate. The cable on the drum connects the power unit to the drive plate through a series of pulleys which provide added mechanical advantage for the drive assembly. Accordingly, upon energization of the drive assembly, the drive plate is pulled toward the power unit with the cable, whereby the abutment is simultaneously advanced toward the wedge to effect the splitting of a log interposed between the abutment and the wedge. When the desired advancement of the ram has been effected in this manner, the power unit is deactivated and resilient spring members attached to the ram and to the track rapidly return the ram to its initial position.

The power unit is preferably driven by a 12 volt DC electric motor so that it is energizable with a conventional automotive battery whereby the splitter can be operated in even remote locations.

The power unit is adapted for safe and simple operation, being controlled by a three position operating lever which is movable between advance, hold and release positions. The power unit is energized by moving the lever away from the wedge to advance the ram and is denergized by moving the lever toward the wedge to allow the ram to return via the spring members. An intermediate substantially vertical position of the lever holds the ram stationary on the track by means of an internal clutch in the power unit. When the ram is moved into close proximity with the wedge, the lever engages the ram housing, and is thereby automatically moved to the hold position to prevent damage to the apparatus. The return travel of the ram is adjustably controllable via a slide bracket on the ram which is positionable to engage the lever at a predetermined ram position and thereby move the lever from the release position to the hold position. This permits adjustment of the apparatus for splitting logs of particular sizes so that when splitting shortened logs, the cycle time is correspondingly reduced in duration.

Accordingly, it is an object of the instant invention to provide an effective and efficient log splitting apparatus of relatively low cost.

Another object of the instant invention is to provide a log splitting apparatus which utilizes a comparatively simple mechanical drive mechanism.

A still further object of the instant invention is to provide a log splitting apparatus having a comparatively short splitting cycle time.

Still another object of the instant invention is to provide a log splitting apparatus which can be operated in remote locations.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 6 is a side elevational view of the apparatus with portions of the ram housing broken away and with the ram returned to an intermediate position on the track; and FIG. 7 is a side elevational view thereof with portions of the ram housing broken away with the ram at its fully advanced position.

DESCRIPTION OF THE INVENTION

Figure 1:
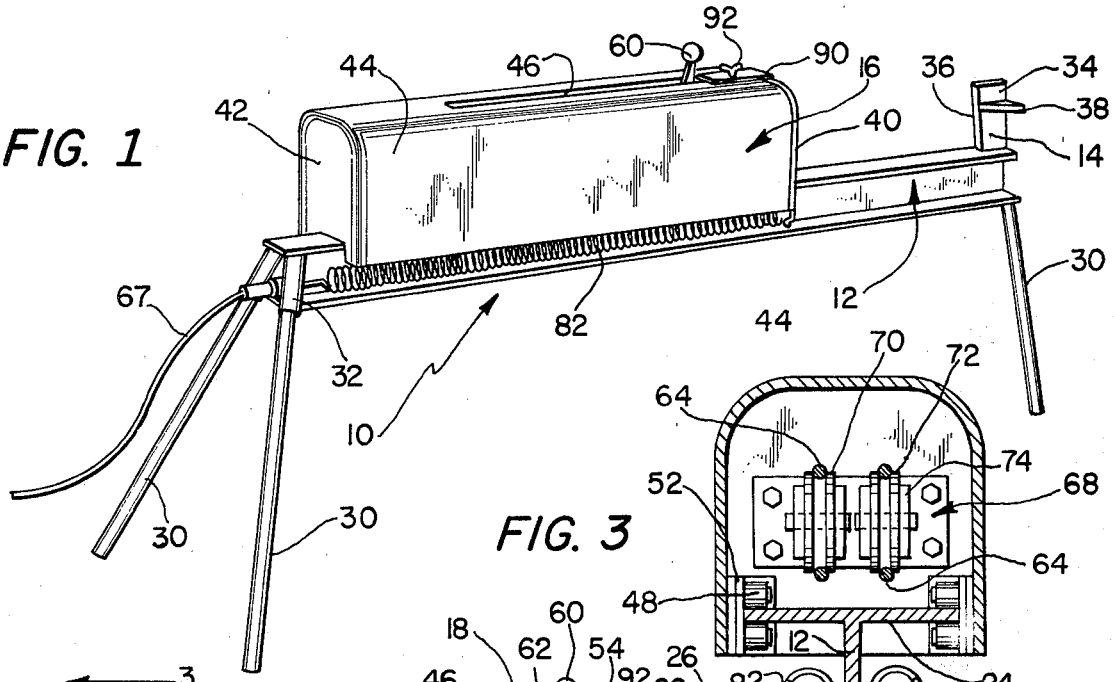
FIG. 1 is a perspective view of the wood splitting apparatus of the instant invention.

Referring now to the drawings, the apparatus of the instant invention is illustrated in FIGS. 1 through 7 and is generally indicated at 10. The apparatus 10 generally comprises a track 12, an upstanding splitting wedge 14 which is attached to one end of the track 12, a ram 16 which is adapted for sliding movement on the track 12 and a drive assembly 18 which is operable to advance the ram 16 towards the wedge 14. The splitting of a log 20 that is interposed between the ram 16 and the wedge 14 on the track 12 is effected by advancing the ram 16 towards the wedge 14 with the drive assembly 18. This causes the gradual insertion of the wedge 14 longitudinally into the log 20 whereby the two longitudinal log sections thereby defined are gradually urged apart.

The track 12 is the main structural element of the apparatus 10 and must be of suitable rigid construction to withstand the substantial forces which are created during the wood splitting operation. For this reason the track 12 as herein embodied comprises an I-beam structure having a main vertical member 22, upper and lower outwardly extending flanges 24 and 26 respectively. The track 12 is mounted in substantially horizontal disposition at a convenient height for operation on three legs 30 which are removably received in sockets 32 attached to the ends of the track 12, whereby the apparatus 10 defines a three legged structure which provides for stability of the apparatus when it is utilized on various irregular terrains. As herein embodied, the legs 30 are removable to facilitate transportation and storage of the apparatus 10. It is understood, however, that various other types of supporting structures as well as other track configurations are contemplated for use.

As hereinabove noted, the splitting wedge 14 operates to effect the splitting of a log 20 by progressively penetrating the log 20 as it is advanced thereto with the ram 16. In this connection the blade 14 must also be of suitable rigid construction to withstand the substantial forces characteristic of log splitting operations. The wedge 14 is defined by a vertical blade member 34 having a tapered blade edge 36 and substantially horizontal triangular shaped wings 38. The edge 36 is directed generally toward the ram 16 and is inclined slightly upwardly thereto with the wings 38 extending outwardly from the sides of the member 34 to provide a further outward extension of the edge 36. The wedge 14 operates to effect the splitting of logs or the like in a conventional manner upon advancement of the logs 20 thereto, the ram 16, the wings 38 and the edge 36 cooperating to progressively urge the two sections of the log 20 apart.

Figure 3:
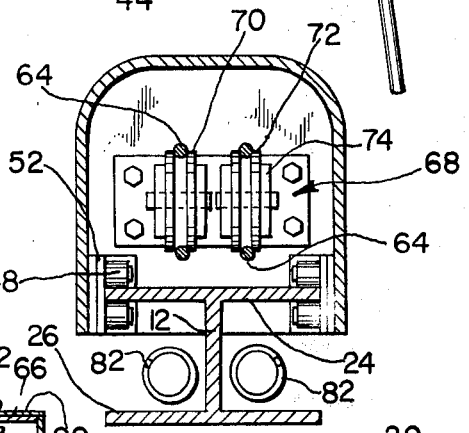
FIG. 3 is an enlarged sectional view taken along line 3—3 in FIG. 2.
Figure 2:
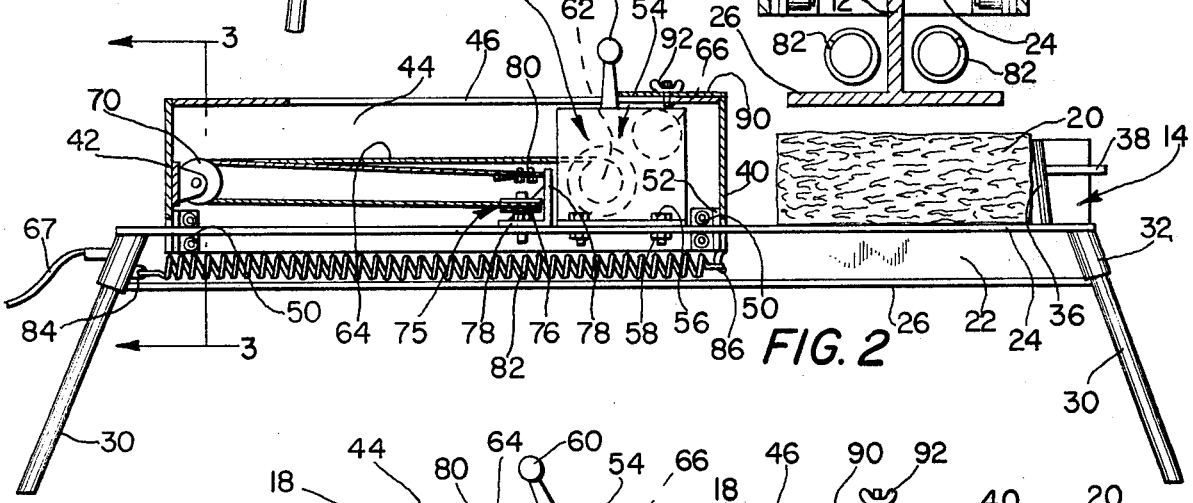
FIG. 2 is a side elevational view thereof with the ram housing shown in section.
Figure 4:
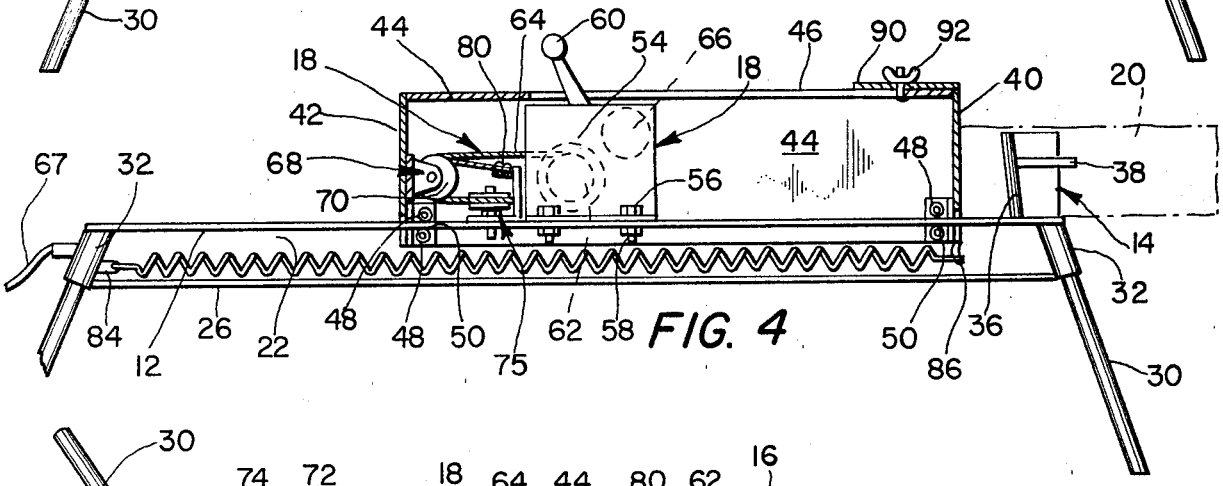
FIG. 4 is a side elevational view of the apparatus with the ram housing shown in section and with the ram at an advanced position.
Figure 5:
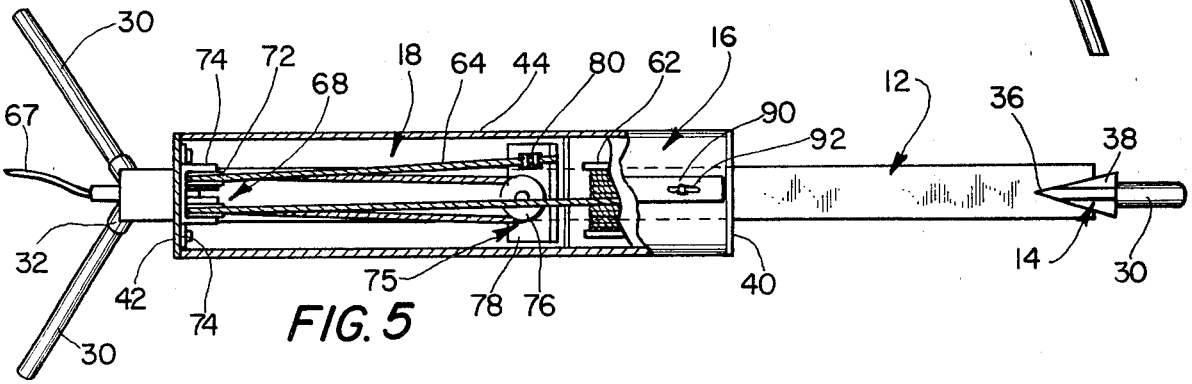
FIG. 5 is a top plan view of the apparatus with portions of the ram housing broken away.

The ram 16 comprises a substantially vertical abutment plate 40, a substantially vertical drive plate 42 which is spaced from the plate 40 on the opposite side thereof from the wedge 14 and an arcuate shaped ram housing 44 which interconnects the plates 40 and 42 and is formed with an elongated longitudinal slot 46 on the upper side thereof. Mounting the ram 16 for traveling movement on the track 12 are spaced apart hardened rollers 48 which bear on the upper and lower surfaces of the flanges 24 as at 50. The rollers 48 are journaled in end brackets 52 that are attached to the plates 40 and 42 adjacent to the lower ends thereof as shown in FIGS. 2, 3 and 4. The ram 16 is also of a suitable rigid construction so as to withstand the substantial forces that occur during the log splitting operation. The rollers 48 and the brackets 52 cooperate with the flanges 24 to mount the ram 16 on the track 12 in a manner that permits traveling movement of the ram 16 even though it is subjected to the aforesaid forces.

The drive assembly 18 which is operable to advance the ram 16 towards the wedge 14 includes a power unit 54 which is securely mounted at an intermediate point on the track 12 by means of threaded bolts 56 that extend through the flanges 24 and that are secured thereto by nuts 58. As will be seen, the power unit 54 is disposed on the track 12 between the plates 40 and 42 so that it is substantially enclosed within the housing 44, the power unit 54 being operated by a drive lever 60 which extends through the slot 46 in housing 44. The slot 46 permits thereby relative movement of the ram 16 on the track 12 without contact thereof with the lever 60. As shown in FIGS. 2 and 4, the power unit 54 includes a cable drum 62 which is rotatable to wind a cable 64 thereon by means of an electric drive motor 66 which is preferably a 12 volt DC motor and which is energized through a power cord 67 and operable by manipulation of the lever 60.

The cable 64 extends from the drum 62 to a drive plate pulley assembly 68 which comprises first and second pulleys 70 and 72 journaled to a bracket 74 mounted on the drive plate 42. A drive unit pulley assembly 75 comprising a horizontal pulley 76 journaled to a bracket 78 mounted on the track 12 adjacent to the power unit 54 also comprises part of the drive assembly 18. The cable 64 and the pulley assemblies 68 and 75 cooperate to provide additional mechanical advantage in the drive assembly 18 in a conventional manner with the cable 64 continuously extending from the drum 62 to the first pulley 70, to the horizontal pulley 76, back to the second pulley 72 and then back to the bracket 78 where it is secured with a cable clamp 80. Upon energization of the motor 66, the cable 64 is wound on the drum 62 and the drive plate 46 is thereby pulled towards the power unit 54 to advance the ram 16 towards the wedge 14. The cable and pulley assembly herein described provides a mechanical advantage of 4 to 1 in a manner well known in the art. It is understood, however, that various other pulley and cable assemblies are possible to provide the same or different mechanical advantages in other embodiments of the invention.

Resilient return springs 82 provided on opposite sides of the track 12 are attached to the track 12 as at 84 and to the ram 16 as at 86 for rapidly returning the ram 16 from the blade 14 upon the unwinding of the cable 64 from the drum 62.

In the preferred embodiment, the power unit 54 is adapted for three modes of operation: a drive mode wherein the drive motor 66 is energized to rotate the drum 62 and thereby wind the cable 64 thereon; a hold mode wherein the drive motor 66 is deenergized but an internal clutch in the power unit 54 holds the drum 62 stationary to prevent the unwinding of cable 64 therefrom; and a release mode wherein the drive motor 66 is deenergized and the drum 62 is freely rotatable to permit the unwinding of the cable 64 therefrom. In this connection, the power unit 54 may comprise a powered winch of the type disclosed in the U.S. patent to ALCOTT, No. 3,773,294 wherein a single operating lever is selectively movable between a hold position, a free position and a wind position. The apparatus 10 as herein embodied is operated by moving the lever 60 generally away from the blade 14 to energize the motor 66 and thereby commence winding of the drum 62. When the desired advancement of the ram 16 towards the wedge 14 has been effected in this manner, the lever 60 is moved to a substantially vertical position wherein the motor 66 is deenergized but the internal clutch in the drive unit 54 is activated to hold the drum 62 stationary and prevent the unwinding of the cable 64 therefrom. The ram 16 is returned from the wedge 14 by moving the lever 60 generally towards the wedge 14 to deactivate the internal clutch in the power unit 54 and permit free movement of the drum 62, thereby allowing the spring members 82 to contract for returning the ram 16 on the track 12.

To further provide for convenient and safe control of the operation of the apparatus 10, the track 12, the ram 16 and slot 46 are dimensioned to prevent the abutment plate 40 from engaging the wedge 14. In particular, as will be noted from FIG. 7, when the ram 16 is fully advanced so that the abutment plate 40 is in close proximity to the wedge 14 the lever 60 engages the end of the slot 46 as at 88 to automatically move the lever 60 from the drive position away from the wedge 14 to the substantially vertical hold position. This virtually eliminates the possibility of damage to the apparatus 10 resulting from the engagement of the ram 16 with the wedge 14.

The extent of the return travel of the ram 16 on the track 12 is obviously controllable by manipulation of the lever 60 to stop the ram 16 at desired locations on the track 12. However, when splitting logs of a particular size, it may be desirable to have the ram 16 automatically stop at a particular point on the track 12 during each successive operating cycle rather than to have the ram 16 return fully to the furthermost position from the wedge 14. For this reason, a slide bracket 90 is mounted on the top of the housing 44 adjacent to the forwardmost position of the slot 46 and is secured in place by a wing nut 92 that provides for adjustably locating the bracket 90 at various locations relative to the forward end of the slot 46. As will be seen most clearly from FIG. 6, by appropriately positioning the bracket 90 relative to the slot 46, the bracket 90 is engaged by the handle 60 at a particular position of the ram 16 on the track 12 to automatically move the handle 60 to the vertical hold position. This terminates the return travel of the ram 16 on the track 12 and thereby permits adjustment of the length of the splitting cycle to accommodate logs of particular lengths. This permits optimization of both the cycle time and the energy usage to increase the efficiency of operation.

It is seen therefore that the instant invention provides an effective apparatus for the splitting of wood. The apparatus is mechanically driven with a comparatively simple drive mechanism to provide a durable splitting apparatus which can be manufactured at relatively low cost. Further the unique drive mechanism is particularly adapted for advancing the ram at a safe but efficient pace while the return springs are adapted to rapidly return the ram to its initial position. Consequently, the apparatus of the instant invention is operable with substantially shorter cycle times than the previously known devices. It is further seen that the apparatus of the instant invention has significant advantages in simplicity of construction and in simplicity and efficiency of operation over the previously known devices and represents a significant improvement in the art of wood splitting apparatus.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An apparatus for splitting wood comprising:

a. an elongated track;

b. a wedge mounted on said track;

c. a ram comprising:

(1) an abutment slidingly mounted on said track for movement generally toward and away from said wedge;

(2) a ram drive plate slidingly mounted on said track for movement generally toward and away from said wedge but spaced from said abutment on the opposite side thereof from said wedge; and (3) connecting means extending between said plate and said abutment communicating movement therebetween; and d. drive means interposed between said abutment and said plate connected to said plate and to said track at a drive point which is spaced from said plate when said head is spaced from said wedge, said drive means advancing said plate toward said drive point and thereby advancing said head toward said wedge, whereby when a wood log is longitudinally disposed on said track between said head and wedge, the splitting thereof is effected by the advancement of said abutment with said drive means.

2. The apparatus of claim 1 further comprising return means for returning said ram from said wedge subsequent to the advancement of said ram thereto.

3. In the apparatus of claims 1 or 2, said drive means comprising:

a. a rotatable drum mounted on said track substantially at said drive point;

b. a flexible drive member extending between said drum and said plate and windable on said drum to advance said plate toward said point upon rotation of said drum; and c. means for rotating said drum.

4. In the apparatus of claim 3, said means for rotating said drum comprising:

a. electric motor drive means mounted on said track; and b. handle control means extending from said motor drive means for effecting the energization thereof.

5. In the apparatus of claim 3, said means for rotating said drum comprising:

a. electric motor drive means mounted on said track;

b. three position handle control means movable between advance, hold and release positions, the advance position being generally away from said wedge, the release position being generally toward said wedge and the release position being interemediate therebetween.

6. The apparatus to claim 5, further comprising forward stop means attached to said ram engageable with said handle control means upon advancement of said ram into proximity with said wedge to move said handle control means to the hold position from the advance position and thereby prevent engagement of said abutment with said wedge.

7. In the apparatus of claim 2, said return means comprising at least one resilient return spring which extends between said ram and said track to return said ram from said wedge upon deactivation of said drive means.

8. The apparatus of claims 5, further comprising return stop means attached to said ram engageable with said handle control means upon return movement of said ram to a predetermined point away from said wedge to move said handle control means from the release position to the hold position.

9. The apparatus of claims 5 further comprising adjustable return stop means adjustably positionable on said ram to engage said handle upon return movement of said ram to a desired location on said track.

10. In the apparatus of claim 5, said electric motor drive means further characterized as 12 volt DC electric motor drive means.

11. The apparatus of claim 6, further comprising return stop means attached to said ram engageable with said handle control means upon return movement of said ram to a predetermined point away from said wedge to move said handle control means from the release position to the hold position.

12. The apparatus of claim 6 further comprising adjustable return stop means adjustably positionable on said ram to engage said handle upon return movement of said ram to a desired location on said track.

13. In the apparatus of claim 6, said electric motor drive means further characterized as 12 volt DC electric motor drive means.

* * * * *